US005997400A

United States Patent [19]

Seelig et al.

[11] Patent Number: 5,997,400

[45] Date of Patent: Dec. 7, 1999

[54] COMBINED SLOT MACHINE AND RACING GAME

[75] Inventors: Mac R. Seelig; Jerald Seelig, both of Absecon; Michael Hiltebrand, Pedricktown; Douglas Cramer, Somers Point, all of N.J.

[73] Assignee: Atlantic City Coin & Slot Services Co., Inc., Pleasantville, N.J.

[21] Appl. No.: 09/115,036

[22] Filed: Jul. 14, 1998

Related U.S. Application Data

[63] Continuation of application No. 08/875,980, filed as application No. PCT/US96/15023, Sep. 19, 1996, Pat. No. 5,779,544, which is a continuation of application No. 08/543,200, Oct. 13, 1995, Pat. No. 5,560,603, and a continuation-in-part of application No. 08/488,270, Jun. 7, 1995, Pat. No. 5,664,998.

[51] Int. Cl.[6] ..... G07F 17/34

[52] U.S. Cl. ..... 463/6; 273/143 R; 463/20

[58] Field of Search ..... 273/143 R, 138.2; 463/6, 20, 66, 68

[56] References Cited

U.S. PATENT DOCUMENTS

| | | | |
|---|---|---|---|
| 1,626,420 | 4/1927 | Mills | 463/68 |
| 2,148,828 | 2/1939 | Myers | 194/240 |
| 2,671,662 | 3/1954 | Carpenter et al. | 463/62 |
| 3,231,987 | 2/1966 | Schott et al. | 434/63 |
| 3,462,152 | 8/1969 | Royston | 273/246 |
| 3,717,345 | 2/1973 | Banville | 463/6 |
| 4,232,866 | 11/1980 | Pennachio | 273/374 |
| 4,570,934 | 2/1986 | Smyth | 273/143 R |
| 4,669,731 | 6/1987 | Clarke | 273/143 R |
| 4,781,377 | 11/1988 | McVean et al. | 463/58 |
| 4,805,907 | 2/1989 | Hagiwara | 463/26 |
| 4,871,171 | 10/1989 | Rivero | 463/20 |
| 4,964,638 | 10/1990 | Ishida | 463/27 |
| 5,116,055 | 5/1992 | Tracy | 463/27 |
| 5,186,460 | 2/1993 | Fongeallaz et al. | 463/6 |
| 5,249,800 | 10/1993 | Hilgendorf et al. | 463/27 |
| 5,280,909 | 1/1994 | Tracy | 463/27 |
| 5,320,351 | 6/1994 | Suzuki | 463/6 |
| 5,398,938 | 3/1995 | Money | 463/61 |

FOREIGN PATENT DOCUMENTS

| | | | |
|---|---|---|---|
| 388103 | 9/1990 | European Pat. Off. . | |
| 2066991 | 7/1981 | United Kingdom | 273/143 R |
| 2205188 | 11/1988 | United Kingdom | 273/138 A |
| 2251558 | 7/1992 | United Kingdom . | |

OTHER PUBLICATIONS

Mills Futurity Bell Machine, Slots 1. Richard M. Bueschel, p. 136, 1978.

*Primary Examiner*—Benjamin H. Layno
*Attorney, Agent, or Firm*—Norman E. Lehrer

[57] ABSTRACT

The gaming system of the present invention includes one or more slot machines associated with a racing display wherein the racing element or elements are not necessarily racing against each other. Rather, the racing element moves each time predetermined combination appears on the slot machine. A player is rewarded if his or her racing element reaches a predetermined position. While a clock may be included with each racing element racing against the clock, the racing elements may move independently of a clock. The racing display may be built directly into the slot machine so that the slot player can easily see the progress of his racing element. Alteratively, a large racing display may be utilized that displays a plurality of racing elements thereby giving the appearance that the racing elements are racing against each other. Even further, Win, Place and Show positions may be located adjacent a finish line and the slot player whose racing element reaches either of these positions is awarded a prize depending on the position reached.

11 Claims, 2 Drawing Sheets

COMBINED SLOT MACHINE AND RACING GAME

CROSS REFERENCE TO RELATED APPLICATIONS

This application is a continuation of U.S. application Ser. No. 08/875,980 filed on Aug. 25, 1997 now U.S. Pat. No. 5,779,544 which was filed under 35 U.S.C. §371 claiming the benefit of International Application No. PCT/US96/15023 filed on Sep. 19, 1996 which claims priority on U.S. application Ser. No. 08/543,200 filed on Oct. 13, 1995 now U.S. Pat. No. 5,560,603. Application Ser. No. 08/875,980 was also a Continuation-in-Part of prior application Ser. No. 08/488,270 filed on Jun. 7, 1995 now U.S. Pat. No. 5,664,998.

TECHNICAL FIELD

The present invention is directed toward a gaming system and, more particularly, toward such a system that combines a slot machine with a racing display that may be built directly into the slot machine or which may be remote therefrom.

BACKGROUND ART

Traditional slot machines commonly in use are normally stand-alone devices intended to be played by a single player. The player inserts one or more coins therein and either pushes a button or pulls a lever to initiate the play. Depending on the final position of the spinning wheels within the slot machine, the machine determines whether or not and how much the player has won.

Applicants' prior U.S. application Ser. No. 488,270, filed Jun. 7, 1995, describes a system wherein a plurality of slot machines may be combined together with a large, overhead racing display which carries a number of racing elements such as automobiles, horses or the like. Each time one of the slot machines wins or each time the handle is pulled or a coin is played, the respective racing element is moved a predetermined distance. Whichever horse or other racing element wins the race, the player at that slot machine is awarded a bonus. The primary purpose of the invention described in the prior invention is to encourage competition between slot players.

While the invention described in Applicants' prior invention may serve the purpose indicated therein, it also can create certain difficulties. Since the horses or other racing elements are racing against each other, all of the slot players must begin at precisely the same time. This would require supervision by an operator or other person which obviously creates additional expense. Even further, a number of the slot machines would be sitting idle and, therefore, not generating income to the casino while waiting for other players so that the race could begin.

Furthermore, because the racing display described in the prior application was remotely located from the slot machine, it might be difficult for the slot players to view the same while playing the slot machine. This might discourage them from playing. Even further, the system described in the prior application suggested that a prize be awarded to the winning horse. As a result, should one of the horses win relatively early in the race because the particular slot machine has "hit" an inordinate number of times, the remaining slot players in the race would stop playing, thereby creating a loss in revenues to the casino operator.

DISCLOSURE OF THE INVENTION

The present invention is intended to overcome the apparent deficiencies in the invention described in Applicants' prior application discussed above and provides a system which will encourage the slot players to continue playing and which is entertaining to both the players themselves and to others who may be watching. The gaming system of the present invention includes one or more slot machines associated with a racing display wherein the racing elements are not racing against each other. Rather, a clock is included and each racing element is racing against the clock, independently of the other racing elements. The racing display may be built directly into the slot machine so that the slot player can easily see the progress of his horse or other racing element. Alternatively, a large racing display such as described in the prior application may also be utilized but wherein each horse is racing against a different clock rather than against each other. Even further, Win, Place and Show positions are located adjacent the finish line and the slot player whose horse reaches either of these positions is awarded a prize depending on the position reached before the clock has timed out.

BRIEF DESCRIPTION OF THE DRAWINGS

For the purpose of illustrating the invention, there are shown in the accompanying drawings forms which are presently preferred; it being understood that the invention is not intended to be limited to the precise arrangements and instrumentalities shown.

BEST MODE FOR CARRYING OUT THE INVENTION

Figure 1:
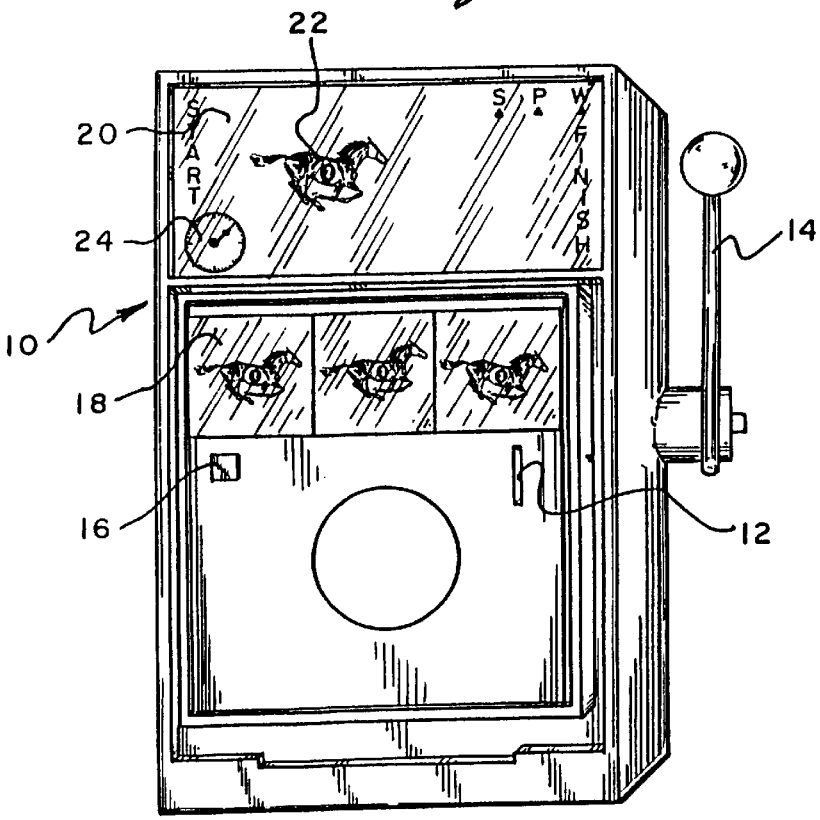
FIG. 1 is a representation of a combined slot machine and racing game in accordance with the principles of the present invention.

Referring now to the drawings in detail wherein like reference numerals have been used throughout the various figures to designate like elements, there is shown in FIG. 1 a combined slot machine and racing game constructed in accordance with the principles of the present invention and designated generally as 10. With the exception of certain modifications and additional features described hereinafter, the slot machine 10 is generally of conventional construction and includes a coin slot 12 and a lever arm 14. The slot machine 10 may also include a push button 16 that can be activated in order to initiate play in lieu of the lever arm 14. The slot machine 12 also includes a display window 18 wherein the results of each play on the machine can be viewed.

Slot machine 10 may be either of the conventional mechanical type with rotating or spinning wheels or of the more modern electronic type of machine wherein only the appearance of rotating wheels is displayed in the display window 18. While three such rotating wheels are shown in slot machine 10, it should be readily apparent that other types of slot machines having fewer or greater numbers of wheels could also be utilized. Furthermore, while the term "rotating wheel" or "spinning wheel" may be used in this application, it should be understood that the term is intended to refer to both mechanical wheels that rotate and the electronic type of displays that merely simulate rotating wheels.

Located in the upper portion of the front of the slot machine 10 is a racing display 20. Racing display 20 includes a racing element such as a horse 22 which is capable of moving across the display 20 from the left to the right. The racing element 22 and the display 20 can either be of the mechanical type wherein a stepping motor and drive chain or the like physically move the horse 22 through a predetermined distance each time a command is received to do so or electrical or electronic types of displays can be utilized such as are more fully described in Applicants' parent application referred to above.

The slot machine 10 also includes a clock or other timing mechanism and a timer display such as shown at 24. The timer display 24 can be either of the analog type or can be a digital display and is preferably arranged to count down. That is, the timer display 24 is preferably arranged so as to initially display a fixed amount of time such as five minutes or the like and then "counts down," i.e. displays continuously lower numbers as time elapses.

On the finish or right side of the display 20 are three distinct markings S, P and W which represent "Show," "Place" and "Win." As shown, the Show position is furthest from the finish line and closest to the start line while the Win position is preferably at the finish line and the Place position is between the Show and Win positions.

A player utilizes the slot machine 10 in a conventional manner. That is, one or more coins are inserted into the coin slot 12 and the lever 14 is pulled or the button 16 is depressed to begin spinning the wheels 18. The first coin played and/or the pulling of the handle 14 or the pushing of the button 16 also initiates the timer display 24. That is, timer display 24 resets to five minutes or some other predetermined time and begins counting down. Furthermore, initiation of the play also resets the racing element such as the horse 22 to the start position. Alternatively, a separate button or the like which, when depressed, can be utilized to reset the timer display 24 and the racing element 22 to await the first coin or the first pull of the handle 14.

After the rotating wheels 18 stop, the slot machine 10 may or may not pay out coins to the player (or award credits) depending on the specific combination of indicia that appear. In this regard, the slot machine 10 functions in a conventional manner to provide a monetary payment to the player when certain predetermined combinations of the indicia on the wheels is displayed.

Each time a particular predetermined combination of indicia appears in the display 18, a signal is generated which advances the racing element 22 through a particular predetermined distance. Different combinations of the indicia on the wheels 18 could, of course, be selected to move the racing element through different distances. Preferably, the particular combination of indicia on the wheels in display 18 that provides the player with a monetary payment is not a combination which moves the racing element 22. Conversely, the particular preselected combination of indicia that moves the racing element 22 preferably does not provide the player with a monetary payment. This adds excitement and interest to continuing the play of the game since a player has an opportunity to win his race even if the slot machine does not pay during any particular pull of the handle 14.

The timer display 24 continues to count down as the player plays the slot machine 10. Each time that the predetermined combination of indicia such as the three horses shown on the display 18 appears, the racing element 22 moves toward the finish line. The principal object of this aspect of the slot machine 10 is, of course, to attempt to have the player's horse 22 reach the finish line before the timer display 24 times out. Once the timer display 24 does time out, the game is over and means are provided for sensing the position of the racing element 22. If the horse has reached the Show line, a prize is awarded. This may be done through the slot machine 10, i.e. by paying additional coins to the player in the conventional manner or a separate award or prize may be given to the player by the proprietor. If the horse 22 has reached the Place position, a prize is also awarded which preferably is of a greater value than the Show prize. Should the horse 22 reach the Win line before the timer display 24 times out, an even greater prize is awarded.

Figure 2:
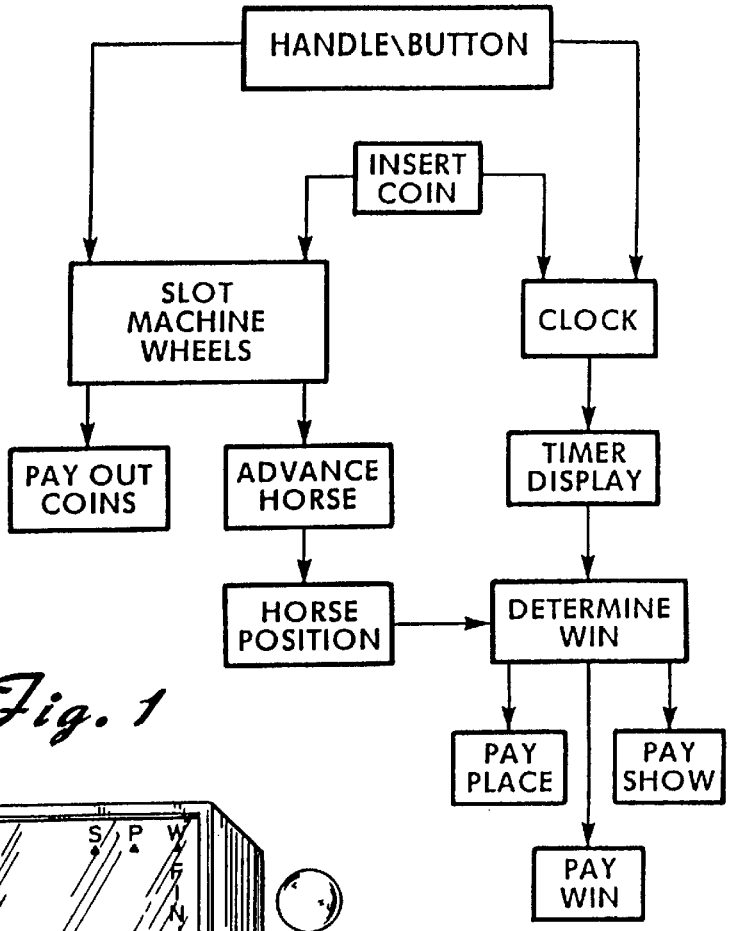
FIG. 2 is a flow chart showing the operation of the invention.

FIG. 2 is a combined schematic and logic diagram essentially illustrating the progression of the play of the game as outlined above. In summary, when a coin is inserted, the clock initiates the timer display and the slot machine wheels are initiated so that they will rotate upon the pull of the handle or push of the button. Depending on the particular combination of indicia on the wheels when they stop rotating, either coins will be paid out in the conventional manner or the racing element will advance. When the timer display times out, the position of the racing element is determined and appropriate payment is made if the racing element reaches the Win, Place or Show position.

Figure 3:
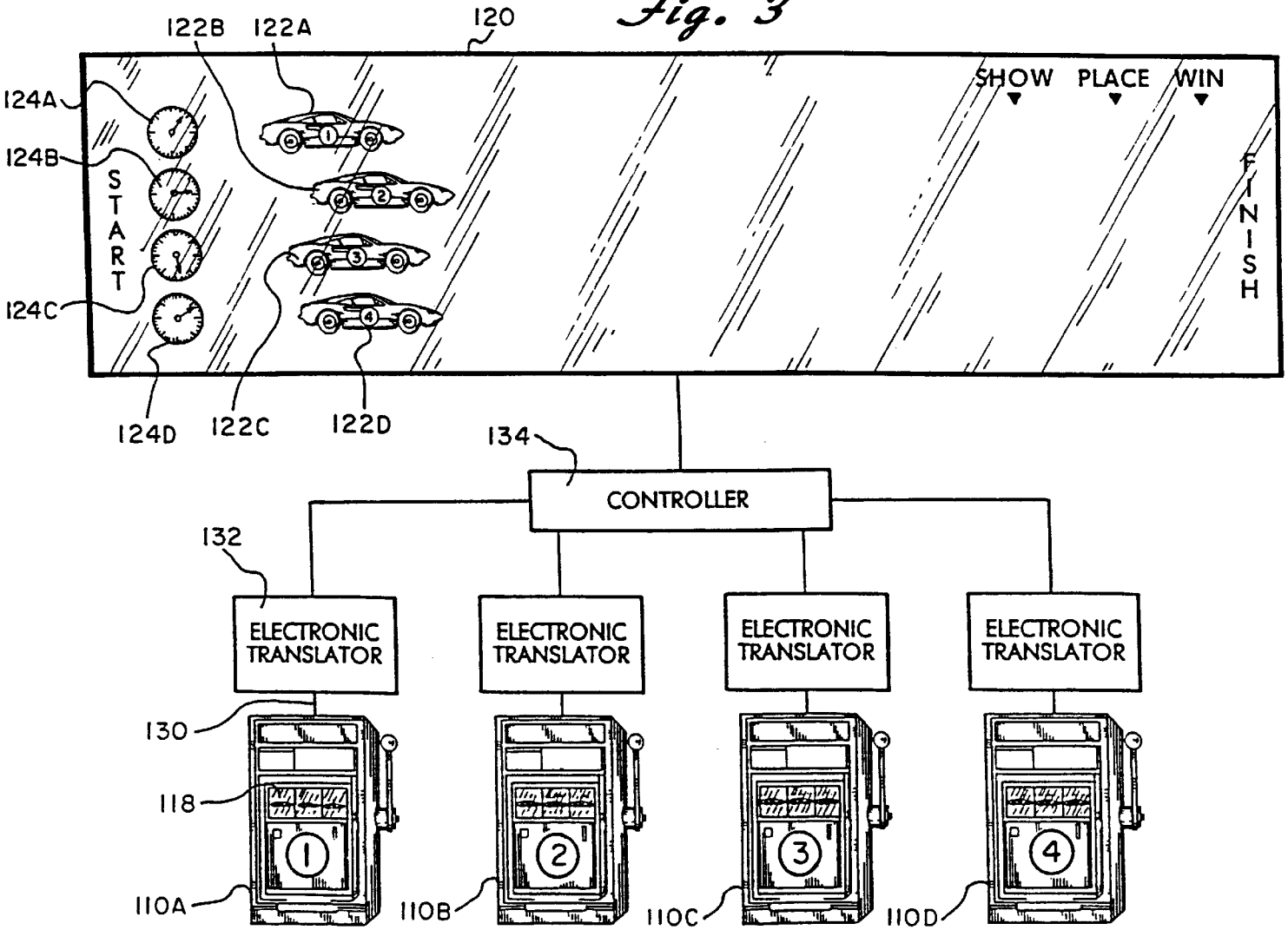
FIG. 3 is an overall view, partly in schematic form, of a second embodiment of the invention including a plurality of slot machines and racing elements.

FIG. 3 illustrates a modified form of the invention described above. In this embodiment of the invention, a plurality of slot machines are utilized such as shown at 110A, 110B, 110C and 110D. While four such slot machines are shown, it should be readily apparent that a fewer or greater number of machines may be utilized.

Located above the series of slot machines is a racing display 120. Preferably, the racing display 120 is located in a position which, while remote from the slot machines, is capable of being easily viewed by the players of the slot machines and by other spectators who may gather around. The racing display 120 includes a plurality of racing elements thereon such as shown at 122A, 122B, 122C and 122D. Each racing element corresponds with a particular slot machine. The slot machines 110A–110D and the racing elements 122A–122D are arranged and operate in a manner very similar to that described in Applicants' U.S. application Ser. No. 488,270, filed Jun. 7, 1995, application incorporated herein by reference. That is, when a certain condition of play is sensed in slot machine 110A such as the appearance of three horses on the rotating wheels 118, an output signal is generated on line 130. Line 130 is connected to an electronic translator circuit 132 which interprets the output signal and converts the same to a useful electrical signal such as a current pulse or a series of pulses which are, in turn, delivered to the controller circuit 134. The controller circuit 134 is, in turn, connected to the racing display 120 and a particular racing element such as racing element 122A is then advanced by a predetermined distance. As with the display 20, the racing display 120 can either be of the mechanical type such as shown or of an electronic or electrical type.

Each slot machine and each racing element is provided with its own timer display such as shown at 124A, 124B, 124C and 124D at the left side of the racing display 120. Thus, instead of racing against the other slot machine players, each player is racing against his or her own clock. The player will win or lose depending on whether his or her respective car or other racing element 122A–122D reaches the Win, Place or Show line before his or her timing display times out. A particular timing display is initiated when the player begins to play on the corresponding slot machine in the manner described above with respect to the embodiment of the invention shown in FIG. 1. In this way, it is not necessary for all of the players to begin at the same time. As a result, the slot machines will be in more continuous use.

It should be readily apparent that it is also possible to combine the features of the slot machine 10 shown in FIG. 1 with the arrangement shown in FIG. 3. That is, each of the slot machines 110A–110B could also include its own racing display so that the player can more easily watch his or her racing element without having to look up at the main racing display 120. Each slot machine 110A–110D may also have its own timer display which would correspond exactly to the timer displays 124A–124D or which may be used in lieu of the timer displays 124A–124D so that the player can again more easily keep track of his or her remaining time.

In the embodiment of the invention described above, the racing elements are moved when a particular combination of indicia such as three horses appears on the slot machine wheels as displayed at 18 or 118. It is also possible, however, to advance the racing elements based on other criteria. For example, a signal could be generated to move the racing element one unit for every coin that is inserted into the slot machine or each time that the handle is pulled (or the button of the slot machine is pushed in lieu of the handle). Furthermore, if the pull of the handle is used as the criteria for moving the racing element, the distance that the racing element is moved could depend on the number of coins that were played during that handle pull.

Even further, combinations of the above-described criteria can be utilized. That is, the racing elements can be moved each time a coin is deposited or the handle is pulled and the racing elements can be moved even further if a predetermined combination of indicia appears on the displays 18 or 118.

The present invention may be embodied in other specific forms without departing from the spirit or essential attributes thereof and accordingly reference should be made to the appended claims rather than to the foregoing specification as indicating the scope of the invention.

We claim:

1. A gaming system comprising:

a slot machine including means for accepting a bet, said machine including a plurality of indicia displayed thereon, said slot machine including means for making a payment to a player when said slot machine displays a first predetermined combination of said indicia;

a racing display including a movable racing element;

said slot machine further including an output signal generated only when said slot machine displays a second predetermined combination of indicia;

said output signal coupled to said racing display to cause said racing element to move through a predetermined distance, and means for rewarding the player if said racing element reaches a predetermined position.

2. The system as claimed in claim 1 wherein said racing display is contained within said slot machine.

3. The system as claimed in claim 1 wherein said racing display is an electronic video screen that forms part of said slot machine.

4. The system as claimed in claim 1 wherein said slot machine includes an electronic video display.

5. The system as claimed in claim 1 wherein the appearance of said racing element is similar in appearance to at least some of said indicia.

6. The system as claimed in claim 5 wherein said signal is generated when at least one of said displayed indicia is similar to said racing element.

7. The system as claimed in claim 1 wherein said racing display is located remote from said slot machine.

8. The system as claimed in claim 7 further including a plurality of said slot machines and a plurality of racing elements carried by said racing display, the number of said racing elements being equal to the number of said slot machines with each element being associated with a different one of said slot machines.

9. The system as claimed in claim 1 wherein said output signal is affected when a predetermined operating condition of said slot machine is sensed.

10. The system as claimed in claim 9 wherein said condition is a predetermined combination of displayed indicia.

11. The system as claimed in claim 9 wherein said condition depends on the amount of said bet.

* * * * *